US009045300B2

(12) United States Patent
Yamamoto

(10) Patent No.: US 9,045,300 B2
(45) Date of Patent: Jun. 2, 2015

(54) IMAGE FORMING APPARATUS

(71) Applicant: KYOCERA Document Solutions Inc., Osaka-shi, Osaka (JP)

(72) Inventor: Kiyonori Yamamoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/092,701

(22) Filed: Nov. 27, 2013

(65) Prior Publication Data

US 2014/0153963 A1 Jun. 5, 2014

(30) Foreign Application Priority Data

Nov. 30, 2012 (JP) ..... 2012-262822

(51) Int. Cl.
*G03G 15/00* (2006.01)
*B65H 1/10* (2006.01)

(52) U.S. Cl.
CPC ..... *B65H 1/10* (2013.01); *G03G 15/6502* (2013.01)

(58) Field of Classification Search
CPC ..... G03G 15/6502; G03G 21/1623; G03G 21/1633
USPC ..... 271/145; 399/107, 124, 393
See application file for complete search history.

(56) References Cited

U.S. PATENT DOCUMENTS

| | | | | |
|---|---|---|---|---|
| 5,313,257 | A | 5/1994 | Kashima et al. | |
| 2007/0090589 | A1* | 4/2007 | Takahashi | 271/162 |
| 2009/0129790 | A1* | 5/2009 | Kang | 399/23 |

FOREIGN PATENT DOCUMENTS

| | | | |
|---|---|---|---|
| EP | 0529803 | A2 | 3/1993 |
| JP | 61132343 | U | 8/1986 |
| JP | 193449 | U | 6/1989 |
| JP | 01172128 | A | 7/1989 |
| JP | 04085218 | A | 3/1992 |
| JP | 05051136 | A | 3/1993 |
| JP | 06179532 | A | 6/1994 |
| JP | 07133050 | A | 5/1995 |
| JP | 08073058 | A | 3/1996 |
| JP | 11092011 | A | 4/1999 |
| JP | 2002068535 | A | 3/2002 |
| JP | 2007112590 | A | 5/2007 |
| JP | 2008110850 | A | 5/2008 |
| JP | 2008222420 | A | 9/2008 |
| JP | 2009126713 | A | 6/2009 |

* cited by examiner

*Primary Examiner* — David Gray
*Assistant Examiner* — Thomas Giampaolo, II
(74) *Attorney, Agent, or Firm* — Alleman Hall McCoy Russell & Tuttle LLP

(57) ABSTRACT

An image forming apparatus includes a housing including a first wall portion extending in a vertical direction, a second wall portion extending in the vertical direction on a side opposite from the first wall portion, and an internal space formed between the first wall portion and the second wall portion. In a first state in which a sheet cassette is not attached to the housing, a cover member seals an opening portion formed in the second wall portion and through which the sheet cassette passes through, and forms part of the second wall portion. In a second state in which the sheet cassette is attached to the housing, the cover member is pivoted by being abutted by part of the sheet cassette and covers a top of a portion of the sheet cassette that is exposed to the outside of the housing.

10 Claims, 14 Drawing Sheets

IMAGE FORMING APPARATUS

INCORPORATION BY REFERENCE

This application is based upon and claims the benefit of priority from the corresponding Japanese Patent Application No. 2012-262822 filed on Nov. 30, 2012, the entire contents of which are incorporated herein by reference.

BACKGROUND

The present disclosure relates to an image forming apparatus that forms an image on a sheet.

Conventionally, in an image forming apparatus that forms an image on a sheet, an image forming portion including a photosensitive drum, an exposure device, a developing device, a transfer device, and a fixing device is disposed. An electrostatic latent image is formed on the photosensitive drum by the exposure device, and the electrostatic latent image is made visible as a toner image by the developing device. Then, the toner image on the photosensitive drum is transferred onto a sheet by the transfer device. The sheet onto which the toner image has been transferred is subjected to a fixing process by the fixing device, and then discharged.

In an image forming apparatus as described above, a sheet cassette is disposed in which a plurality of sheets are stacked and that is detachable from the body of the image forming apparatus. A sheet having a length greater than the depth of the apparatus body is accommodated in such a sheet cassette, and thus techniques enabling the sheet cassette to be extendable are known. The sheet cassette in the extended state is inserted into the apparatus body from a wall portion on one side of the apparatus body, and then attached to the apparatus body in a protruding manner from a wall portion of the apparatus body on the other side to the outside of the apparatus body. At this time, if the top face portion of the sheet cassette protruding to the outside of the apparatus body is exposed to the outside, a foreign object such as a clip may fall on and enter into the apparatus body. For example, a sheet cassette including a lid member that is extendable together with the cassette body is known. Also known is a technique in which a cover member that is extended in the attachment direction of the sheet cassette is extended in advance inside the apparatus body, and the cover member is moved to the outside of the apparatus body simultaneously with the attachment of the sheet cassette.

SUMMARY

An image forming apparatus according to one aspect of the present disclosure includes a housing, an image forming portion, a sheet cassette, an opening portion, and a cover member. The housing includes a first wall portion extending in a vertical direction, a second wall portion extending in the vertical direction on a side opposite from the first wall portion, and an internal space formed between the first wall portion and the second wall portion. The image forming portion is disposed in the internal space and forms an image on a sheet. The sheet cassette is inserted from the first wall portion into the internal space in an insertion direction intersecting the first wall portion. The sheet cassette is attached to the housing in a protruding manner from the second wall portion to the outside of the housing. The sheet cassette is open at a top thereof, and accommodates the sheet therein. The opening portion is formed in the second wall portion, and the sheet cassette passes through the opening portion. In a first state in which the sheet cassette is not attached to the housing, the cover member seals the opening portion and forms part of the second wall portion. In a second state in which the sheet cassette is attached to the housing, the cover member is pivoted by being abutted by part of the sheet cassette and covers a top of a portion of the sheet cassette that is exposed to the outside of the housing.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
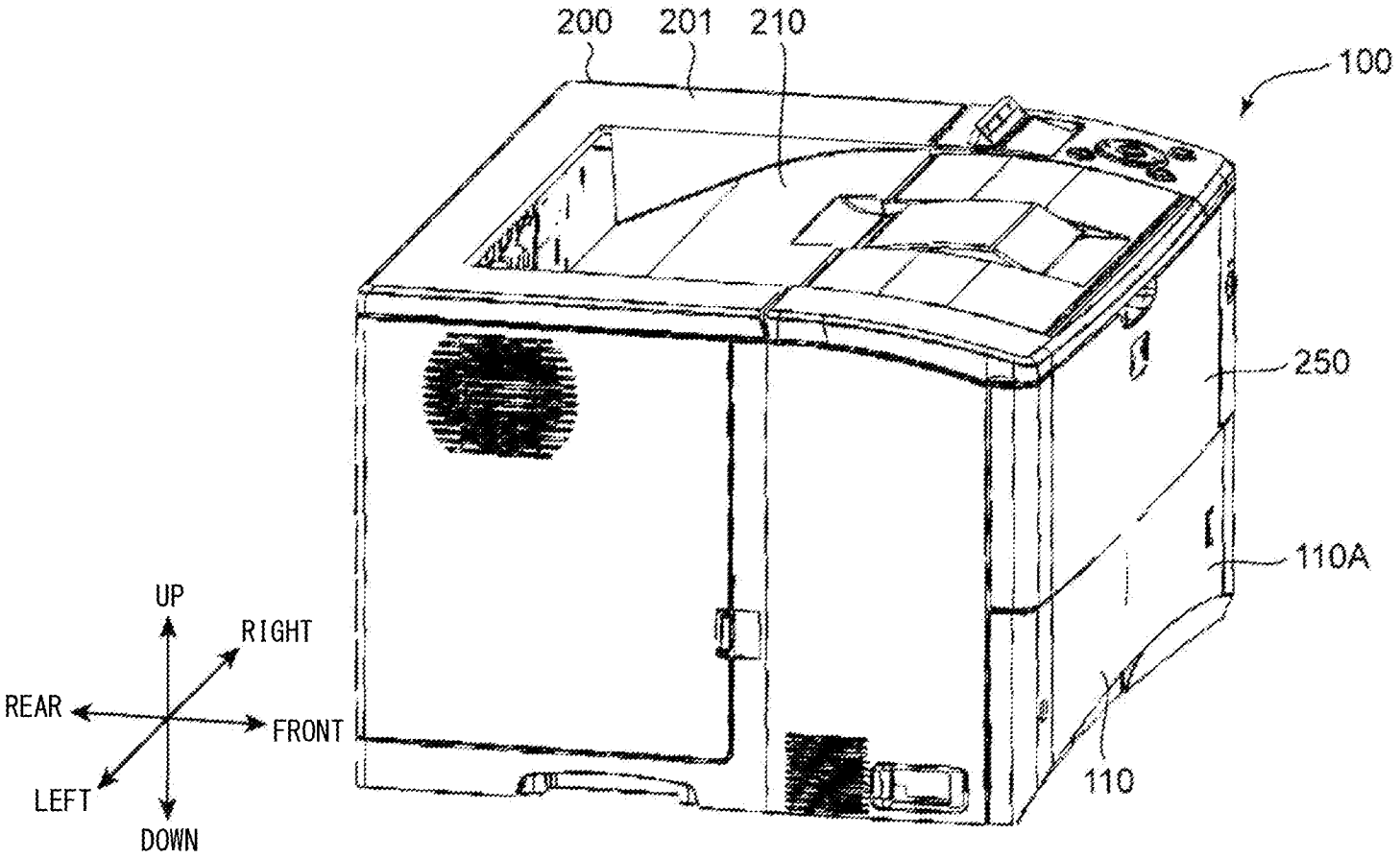
FIG. 1 is a perspective view of a printer according to one embodiment of the present disclosure.
Figure 2:
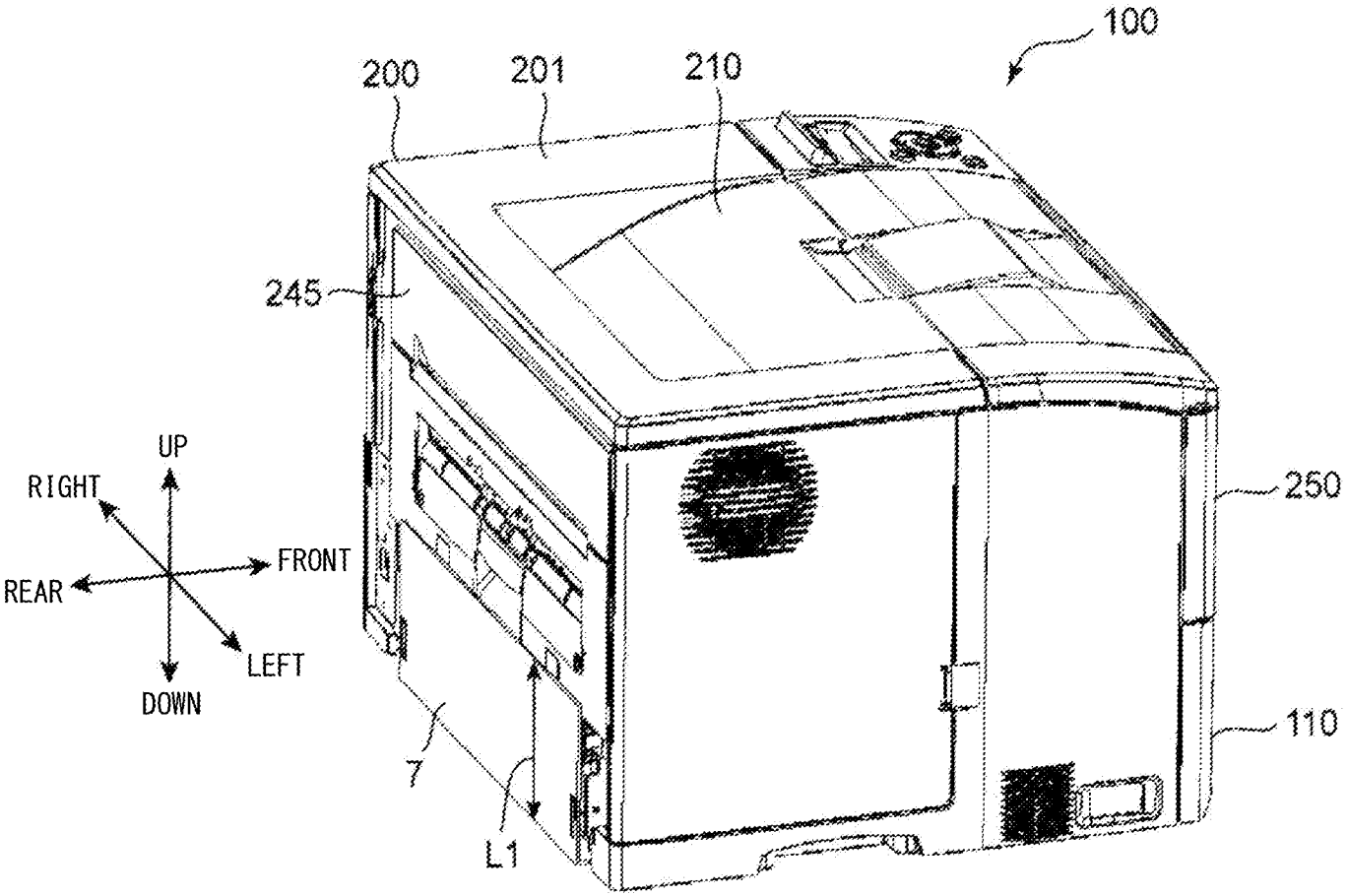
FIG. 2 is a perspective view of the printer according to one embodiment of the present disclosure.
Figure 3:
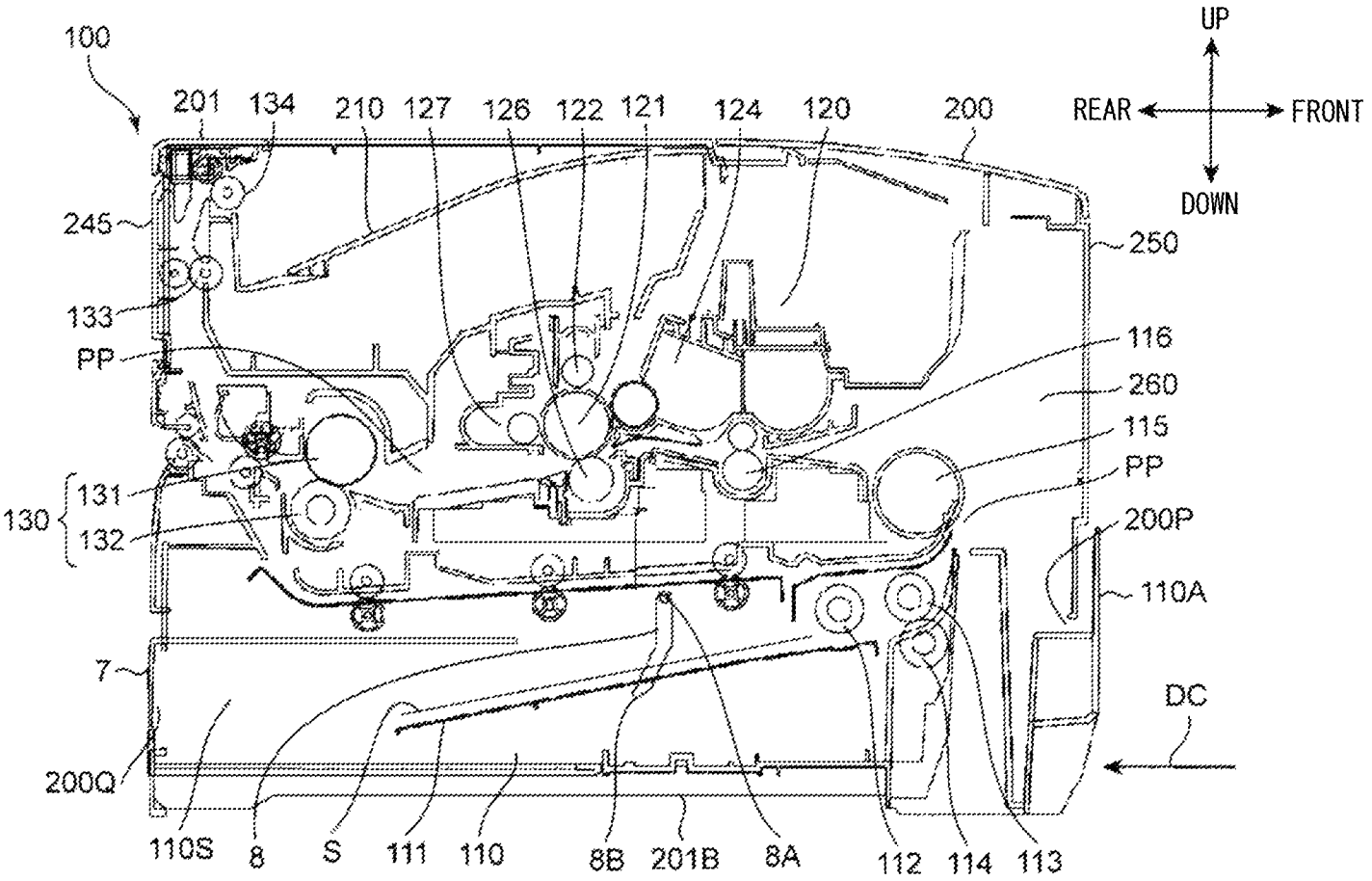
FIG. 3 is a sectional view schematically showing the internal structure of the printer according to one embodiment of the present disclosure.

Hereinafter, one embodiment of the present disclosure will be described with reference to the drawings. FIGS. 1 and 2 are perspective views of a printer 100 (image forming apparatus) according to one embodiment of the present disclosure. FIG. 3 is a sectional view schematically showing the internal structure of the printer 100 shown in FIGS. 1 and 2. The printer 100 shown in FIGS. 1 to 3, which serves as an image forming apparatus, is a so-called monochrome printer. However, in other embodiments, the image forming apparatus may be a color printer, a facsimile device, a multifunction peripheral having these functions, or a different device for forming a toner image on a sheet. Note that directional terms such as "up", "down", "front", "rear", "left", and "right" used in the following description are merely provided to clarify the description, and thus are by no means intended to limit the principles of the image forming apparatus.

The printer 100 includes a housing 200 that accommodates various devices for forming an image on a sheet S. The housing 200 includes a top wall 201 that defines the top face of the housing 200, a bottom wall 201B (FIG. 3) that defines the bottom surface of the housing 200, a back wall 245 (FIG. 3) between the top wall 201 and the bottom wall 201B, and a front wall 250 located forward of the back wall 245. The front wall 250 (first wall portion) is a wall portion extending in the vertical direction, and the back wall 245 (second wall portion) is a wall portion extending in the vertical direction on the side opposite the front wall 250. The housing 200 includes a body internal space 260 (FIG. 3) (internal space) that is formed between the front wall 250 and the back wall 245 and in which various devices are disposed.

At the central portion of the top wall 201 is disposed a sheet discharge portion 210. The sheet discharge portion 210 has an inclined surface that is inclined downward from the front portion to the rear portion of the top wall 201. A sheet S on which an image has been formed in an image forming portion 120, which will be described later, is discharged onto the sheet discharge portion 210.

Referring to FIG. 3, the printer 100 includes a cassette 110 (sheet cassette), an actuator 8, a pickup roller 112, a sheet feed roller 113, a retard roller 114, a conveyance roller 115, a registration roller pair 116, and an image forming portion 120.

The cassette 110 accommodates the sheet S therein in a state in which it is open at its top. The cassette 110 includes a lift plate 111 that supports the sheet S. The lift plate 111 is inclined so as to lift the front edge of the sheet S. The cassette 110 defines part of the front wall 250 of the housing 200, and can be pulled out forward relative to the housing 200.

The actuator 8 is disposed in the body internal space 260 at a position overlapping a cassette cover 7, which will be described later, in the vertical direction. The actuator 8 suitably detects the presence or absence of the sheet S by abutting the sheet S accommodated in the cassette 110. Specifically, the actuator 8 includes a shaft portion 8A and a sheet abutting portion 8B. When the sheet S is accommodated in the cassette 110, the actuator 8 is pivoted about the shaft portion 8A by the sheet abutting portion 8B abutting the sheet S. Upon pivoting of the actuator 8, a light blocking plate (not shown) protruding from the actuator 8 is detected by a photo interrupter (not shown) disposed in the body internal space 260. Additionally, the actuator 8 is disposed so as to enter into the cassette 110 in order for the sheet abutting portion 8B to abut the sheet S.

The pickup roller 112 is disposed above the front edge of the sheet S that is lifted by the lift plate 111. As the pickup roller 112 is rotated, the sheet S is pulled out from the cassette 110. The sheet feed roller 113 is provided downstream of the pickup roller 112. The sheet feed roller 113 sends out the sheet S further downstream. The sheet S that has been sent out by the sheet feed roller 113 is conveyed along a sheet conveyance path PP extending from the cassette 110 via an image forming portion 120, which will be described later, to the sheet discharge portion 210. The retard roller 114 is disposed below the sheet feed roller 113. The retard roller 114 forms a sheet feeding nip portion between itself and the sheet feed roller 113. Additionally, the retard roller 114 has the function of, when a plurality of sheets S enter the sheet feeding nip portion, conveying a single sheet S on top of the plurality of sheets S to the downstream side in the sheet conveyance direction, while preventing the other sheets S from being conveyed.

The conveyance roller 115 is provided downstream in the sheet conveyance direction of the sheet feed roller 113 (hereinafter, "sheet conveyance direction of the sheet feed roller 113" is also simply referred to as "conveyance direction", and "downstream in the sheet conveyance direction of the sheet feed roller 113" is also simply referred to as "downstream"). The conveyance roller 115 conveys the sheet S that has been sent out by the sheet feed roller 113 further downstream. The traveling direction of the sheet S is guided in the opposite direction by the conveyance roller 115.

The registration roller pair 116 has the function of correcting skew conveyance of the sheet S. This enables the position of an image formed on the sheet S to be adjusted. The registration roller pair 116 supplies the sheet S to the image forming portion 120 at the timing of image formation by the image forming portion 120.

The image forming portion 120 is disposed in the body internal space 260, and forms an image on the sheet S. The image forming portion 120 includes a photosensitive drum 121, a charger 122, an exposure device (not shown), a developing device 124, a toner container (not shown), a transfer roller 126, and a cleaning device 127. Of the components of the image forming portion 120, the photosensitive drum 121, the charger 122, the developing device 124, the toner container, and the cleaning device 127 can be removed together as a process unit (not shown) from the housing 200.

The photosensitive drum 121 has a cylindrical shape. The photosensitive drum 121 is configured such that an electrostatic latent image is formed on its circumferential surface and a toner image corresponding to the electrostatic latent image is carried thereon.

The charger 122, to which a predetermined voltage is applied, charges the circumferential surface of the photosensitive drum 121 substantially uniformly.

The exposure device applies laser light to the circumferential surface of the photosensitive drum 121 that has been charged by the charger 122. The laser light is applied according to image data output from an external apparatus (not shown) such as a personal computer connected to the printer 100 in a communicable state. Consequently, an electrostatic latent image corresponding to the image data is formed on the circumferential surface of the photosensitive drum 121. The exposure device is disposed between the sheet discharge portion 210 and the charger 122.

The developing device 124 supplies toner to the circumferential surface of the photosensitive drum 121 on which the electrostatic latent image has been formed. The toner container supplies toner to the developing device 124. The toner container supplies toner to the developing device 124 sequentially or as needed. As the developing device 124 supplies toner to the photosensitive drum 121, the electrostatic latent image formed on the circumferential surface of the photosensitive drum 121 is developed (visualized). Consequently, a toner image is formed on the circumferential surface of the photosensitive drum 121.

The transfer roller 126 is provided rotatably so as to abut the circumferential surface of the photosensitive drum 121. When the sheet S that has been conveyed from the registration roller pair 116 passes between the photosensitive drum 121 and the transfer roller 126, the toner image formed on the circumferential surface of the photosensitive drum 121 is transferred onto the sheet S. Additionally, the transfer roller 126 is disposed on the side opposite the exposure device 123, as viewed from the photosensitive drum 121.

The cleaning device 127 removes toner remaining on the circumferential surface of the photosensitive drum 121 after the toner image has been transferred onto the sheet S. The circumferential surface of the photosensitive drum 121 that has been cleaned by the cleaning device 127 again passes below the charger 122 and is uniformly charged. Thereafter, the above-described toner image formation is newly performed.

The printer 100 further includes a fixing device 130 that fixes the toner image on the sheet S on the downstream side in the conveyance direction relative to the image forming portion 120. The fixing device 130 includes a heating roller 131 that melts the toner on the sheet S, and a pressure roller 132 that causes the sheet S to closely contact the heating roller 131. As the sheet S passes between the heating roller 131 and the pressure roller 132, the toner image is fixed to the sheet S.

The printer 100 further includes a conveyance roller pair 133 provided downstream of the fixing device 130, and a discharge roller pair 134 provided downstream of the conveyance roller pair 133. The sheet S is conveyed upward by the conveyance roller pair 133, and is eventually discharged from the housing 200 by the discharge roller pair 134. The sheet S that has been discharged from the housing 200 is stacked on the sheet discharge portion 210.

Figure 4:
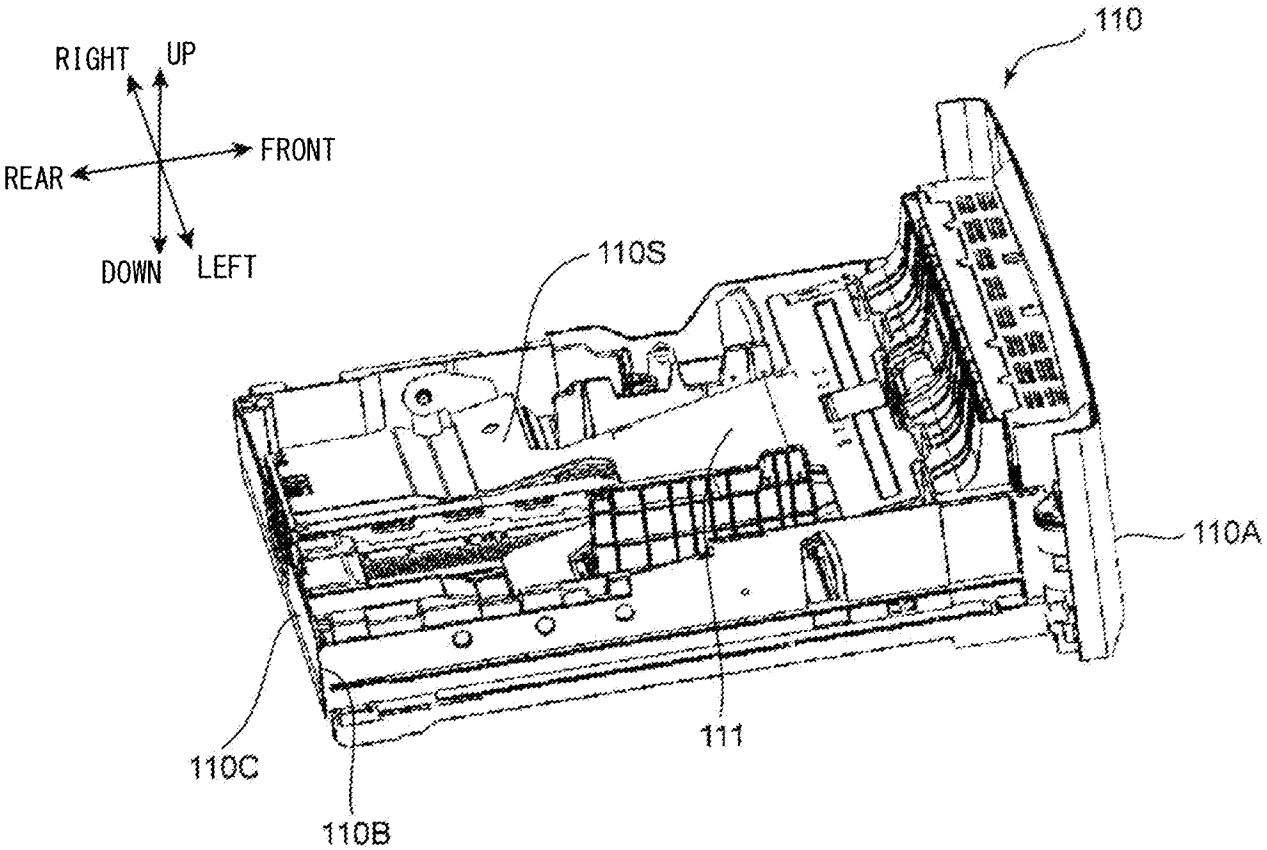
FIG. 4 is a perspective view of a cassette in the contracted state according to one embodiment of the present disclosure.
Figure 5:
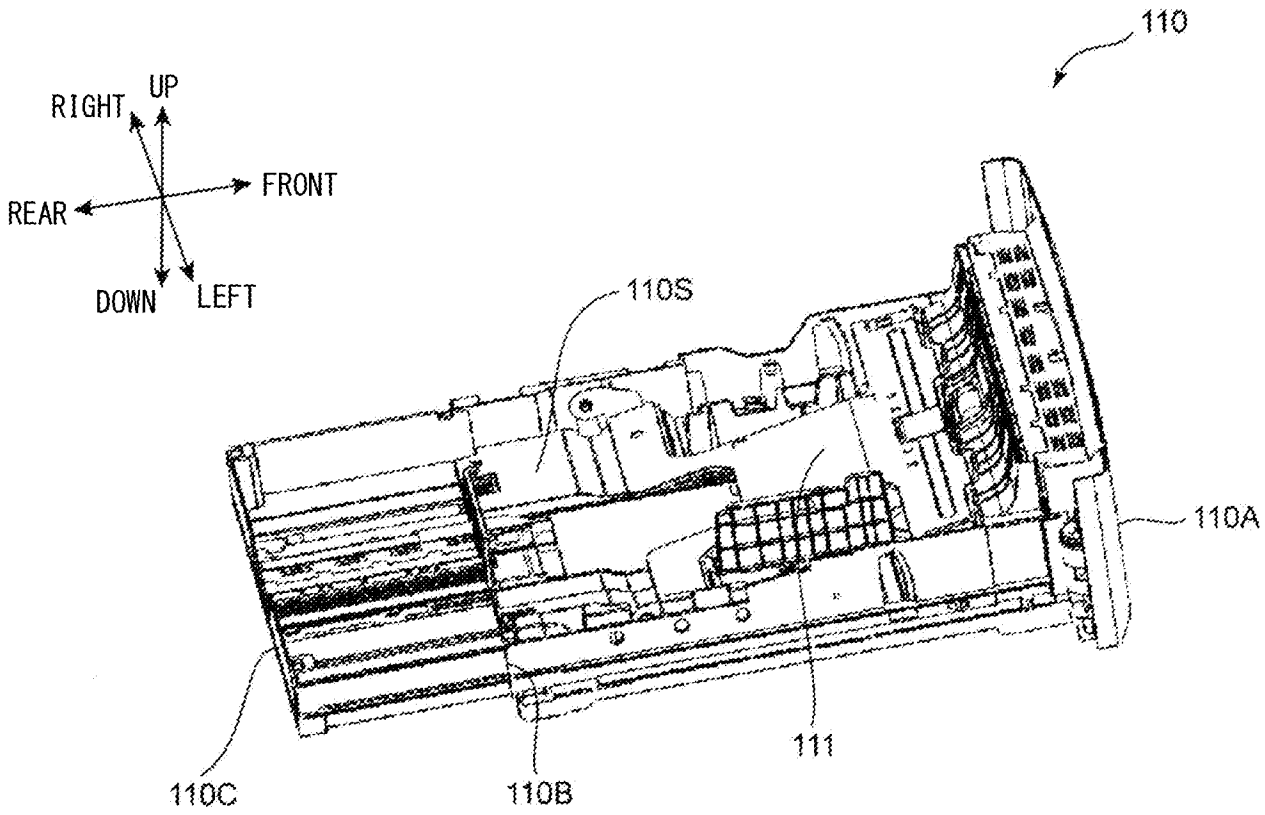
FIG. 5 is a perspective view of the cassette in the extended state according to one embodiment of the present disclosure.

Next, the cassette 110 according to the present embodiment will be described in further details. FIGS. 4 and 5 are perspective views showing the cassette 110 alone. FIG. 4 shows the contracted state of the cassette 110, and FIG. 5 shows the extended state of the cassette 110. The cassette 110 has a box-like shape that is extended in the front-rear direction and the left-right direction). The cassette 110 is open at its top. The cassette 110 includes a cassette front face portion 110A, cassette side rear edges 110B, and a cassette rear face portion 110C (wall portion).

The cassette front face portion 110A is a wall portion on the front side of the cassette 110. When the cassette 110 is attached to the housing 200, the cassette front face portion 110A forms part of the front wall 250 of the housing 200. The cassette side rear edges 110B are edges on the rear side of a lateral pair of side walls of the cassette 110. The cassette rear face portion 110C is a wall portion on the rear side, which is opposite the cassette front face portion 110A. Inside the cassette 110, a sheet accommodating portion 1105 in which the sheet S is accommodated is disposed.

When a sheet S having a size smaller than a predetermined size, as typified by size A4, is accommodated in the sheet accommodating portion 1105, the cassette 110 is attached to the housing 200 in the contracted state shown in FIG. 4. On the other hand, when a sheet S having a size larger the predetermined size, as typified by size A3, is accommodated in the sheet accommodating portion 1105, the cassette 110 is attached to the housing 200 in the extended state shown in FIG. 5. In the extended state of the cassette 110, the bottom and part of the pair of side walls of the cassette 110 together with the cassette rear face portion 110C are slid rearward, whereby the sheet accommodating portion 1105 is enlarged. At this time, as shown in FIG. 5, the cassette rear face portion 110C is disposed rearward relative to the cassette side rear edges 110B at a predetermined interval.

As shown in FIG. 3, the housing 200 includes an insertion portion 200P and an opening portion 200Q. The insertion portion 200P is an opening portion that is open below the front wall 250, and is in communication with the body internal space 260. Meanwhile, the opening portion 200Q is an opening portion that is open below the back wall 245, and is similarly in communication with the body internal space 260. In other words, the housing 200 includes a penetration portion that communicates the body internal space 260 with the outside and extends from the insertion portion 200P to the opening portion 200Q. Additionally, the insertion portion 200P is sealed by the cassette front face portion 110A of the printer 100, and the opening portion 200Q is sealed by the cassette cover 7, which will be described later.

The cassette 110 is inserted from the front wall 250 into the body internal space 260 rearward (in a direction intersecting the front wall 250, the direction indicated by the arrow DC in FIG. 3). When the cassette 110 is in the contracted state (FIG. 4), the cassette rear face portion 110C of the cassette 110 inserted in the body internal space 260 is disposed inside the back wall 245 (see FIGS. 2 and 7). On the other hand, when the cassette 110 is in the extended state (FIG. 5), the cassette 110 inserted in the body internal space 260 passes through the opening portion 200Q, and the cassette rear face portion 110C protrudes from the back wall 245 to the outside of the housing 200 (see FIGS. 6 and 8).

Figure 11:
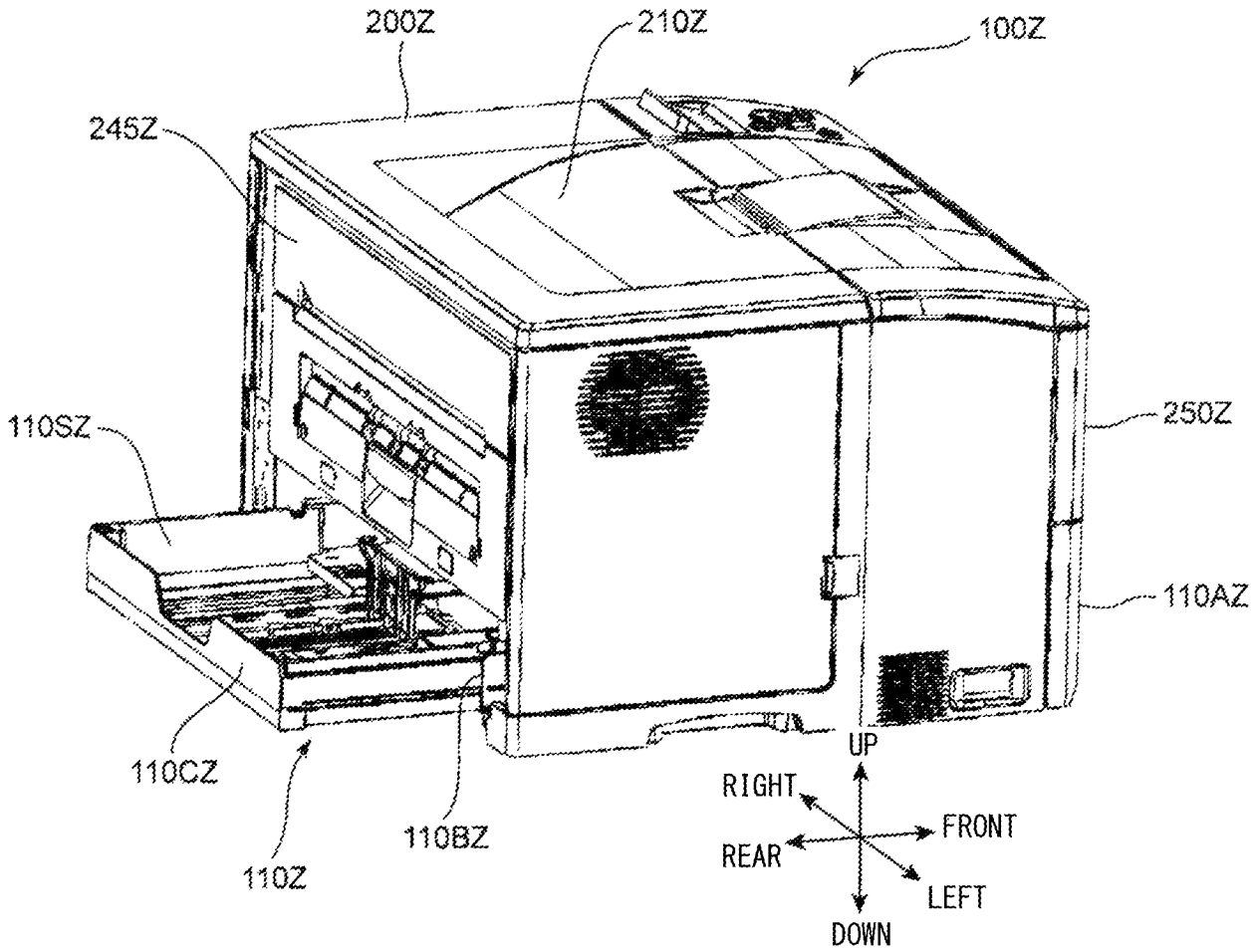
PRIOR ART Fig. 11
FIG. 11 is a perspective view of a printer that is to be compared with the printer according to one embodiment of the present disclosure, with a cassette attached thereto.
Figure 12:
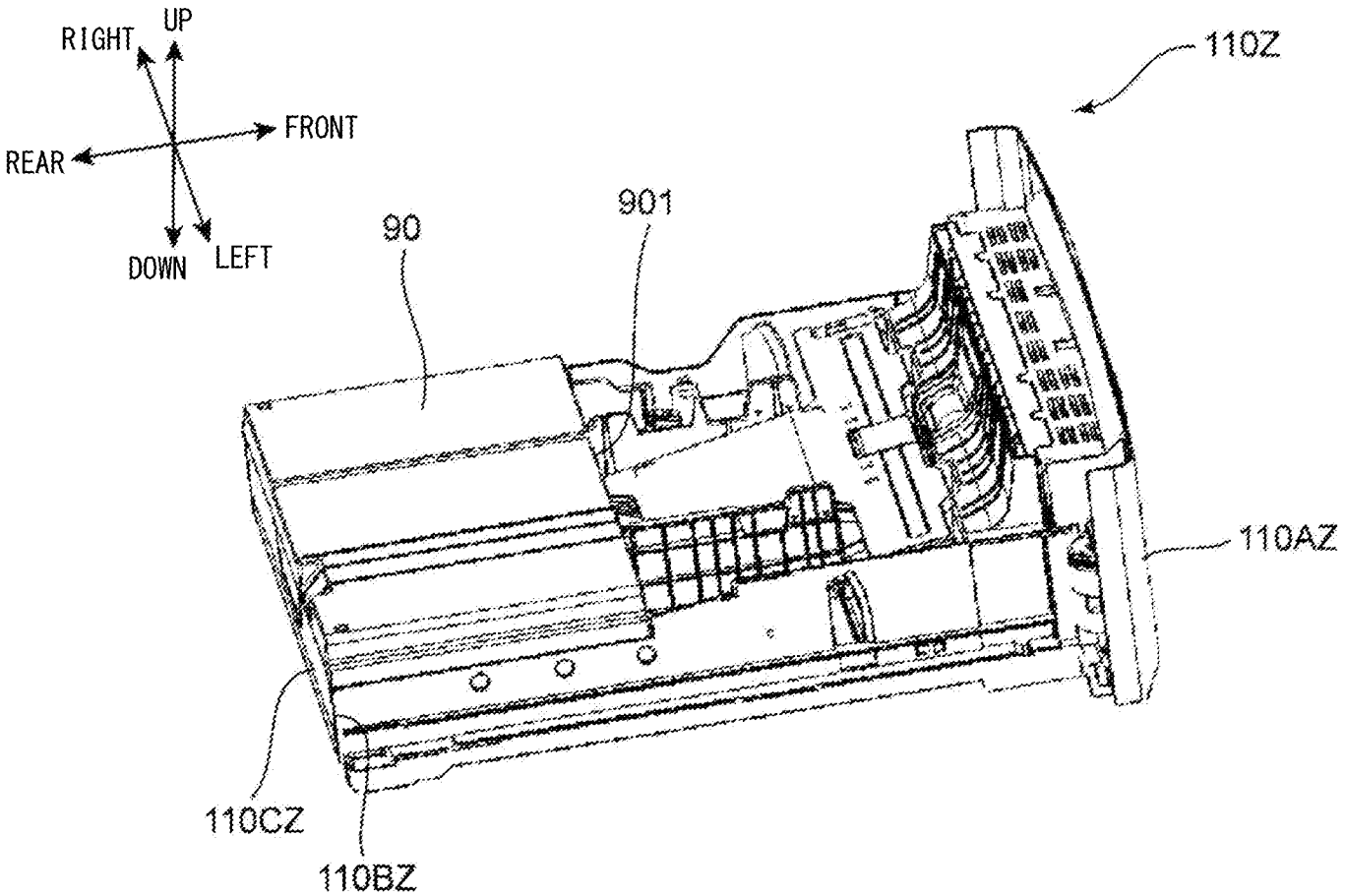
PRIOR ART Fig. 12
FIG. 12 is a perspective view of a cassette in the contracted state that is to be compared with the cassette according to one embodiment of the present disclosure.
Figure 13:
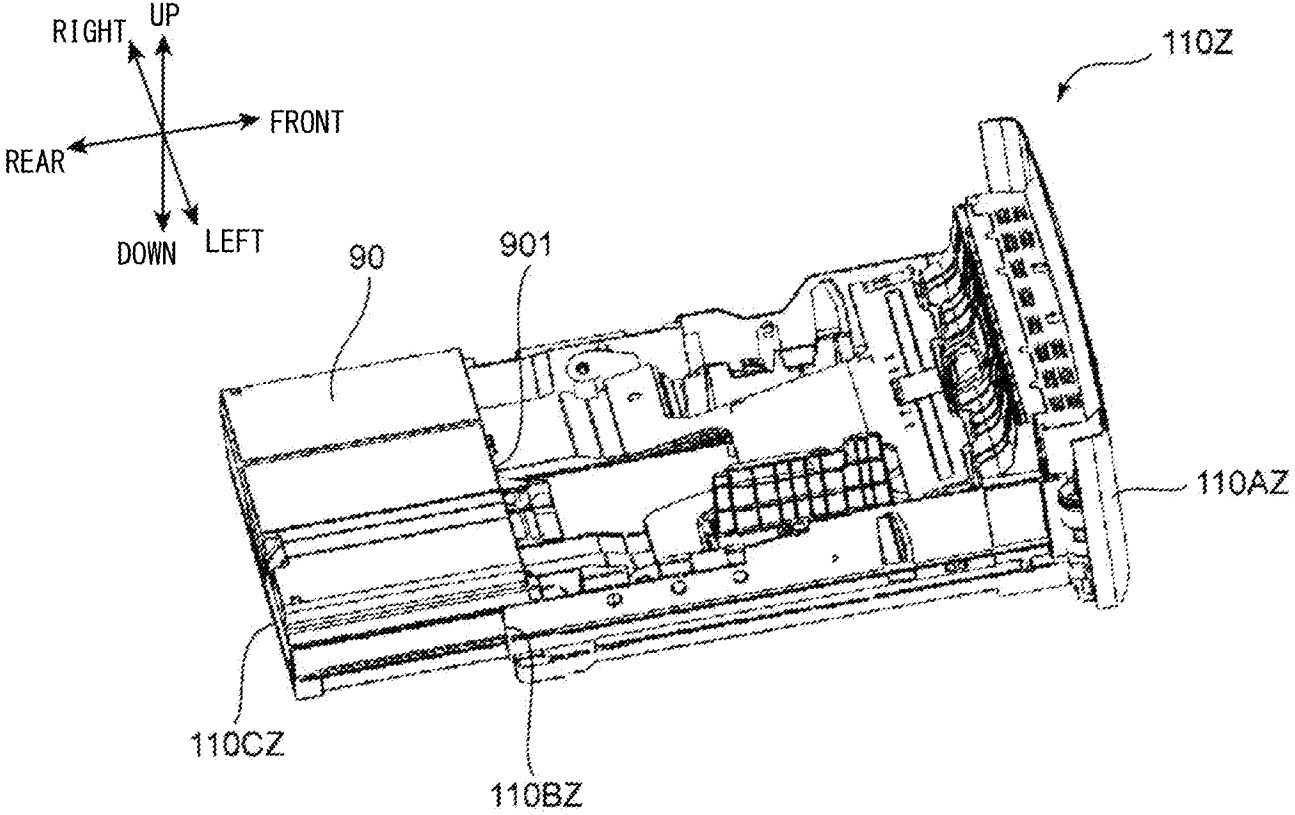
Fig. 13 PRIOR ART
FIG. 13 is a perspective view of a cassette in the extended state that is to be compared with the cassette according to one embodiment of the present disclosure.
Figure 14:
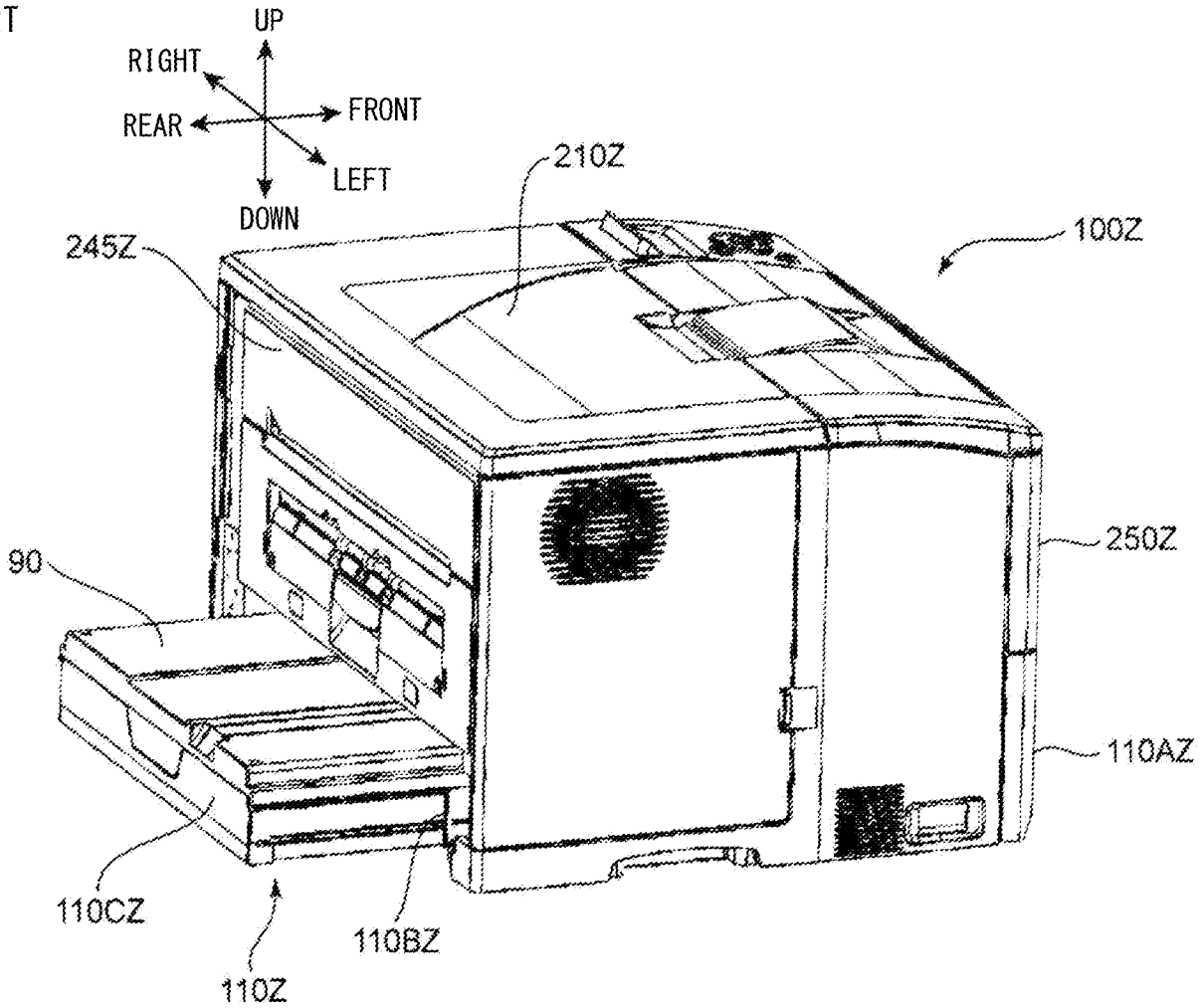
PRIOR ART Fig. 14
FIG. 14 is a perspective view of a printer that is to be compared with the printer according to one embodiment of the present disclosure, with a cassette attached thereto.

Next, the problems of a printer 100Z that is to be compared with the printer 100 according to the present embodiment will be described. Similarly to the printer 100, the printer 100Z includes a cassette 110Z. As with the cassette 110 according to the present embodiment, the cassette 110Z is extendable according to the size of the sheet S accommodated therein. FIGS. 11 and 14 are perspective views of the printer 100Z with the cassette 110Z attached to the printer 100Z. FIG. 12 is a perspective view of the cassette 110Z in the contracted state. FIG. 13 is a perspective view of the cassette 110Z in the extended state.

The cassette 110Z is inserted rearward from the front wall 250Z side into the housing 200Z. When the cassette 110Z is attached to the housing 200Z in the extended state, the sheet accommodating portion 110SZ of the cassette 110Z is exposed to the outside as shown in FIG. 11. Entry of a foreign object such as a clip into the sheet accommodating portion 110SZ may cause a scratch in the sheet S, or a foreign object may be transported into the housing 200Z together with the sheet S, resulting in a damage in the interior of the apparatus. For this reason, a cover 90 as shown in FIGS. 12 and 13 is attached to the cassette 110Z. The cover 90 is moved together with the cassette rear face portion 110CZ when the cassette 110Z is extended or contracted. Also, the cover 90 is inserted inside the housing 200Z, together with the cassette 110Z. Consequently, as shown in FIG. 14, the top of the cassette 110Z protruding to the outside from the inside of the housing 200Z is protected by the cover 90. Thus, the above-described entry of a foreign object into the sheet accommodating portion 110SZ can be inhibited.

On the other hand, the following problems arise when the cover 90 is integrated with the cassette 110Z and is moved through the inside of the housing 200Z as in this case. In addition to the image forming portion, various members are disposed inside the housing 200Z of the printer 100Z. These members include members disposed above the cassette 110Z. One of such members is the above-described actuator 8 included in the printer 100 according to the present embodiment. The actuator 8 extends downward so as to enter the inside of the cassette 110Z (see FIG. 3). Accordingly, when the cassette 110Z is pulled out forward from the state shown in FIG. 14 in which the cassette 110Z is attached, a front edge portion 901 of the cover 90 interferes with the actuator 8. Similarly, there have been cases where the cover 90 interferes with the members disposed inside the housing 200Z as a result of being forcibly pulled out forward together with the cassette 110Z. This may result in a damage in the actuator 8. Furthermore, in a configuration in which the cover member that is extended in the attachment direction of the sheet cassette 110Z is extended in advance inside the apparatus body and the cover member is moved to the outside of the apparatus body upon attachment of the sheet cassette 110Z, there have been cases where interference between the actuator 8 and the cover member similarly occurs when the cover member is moved through the inside of the apparatus body.

Figure 6:
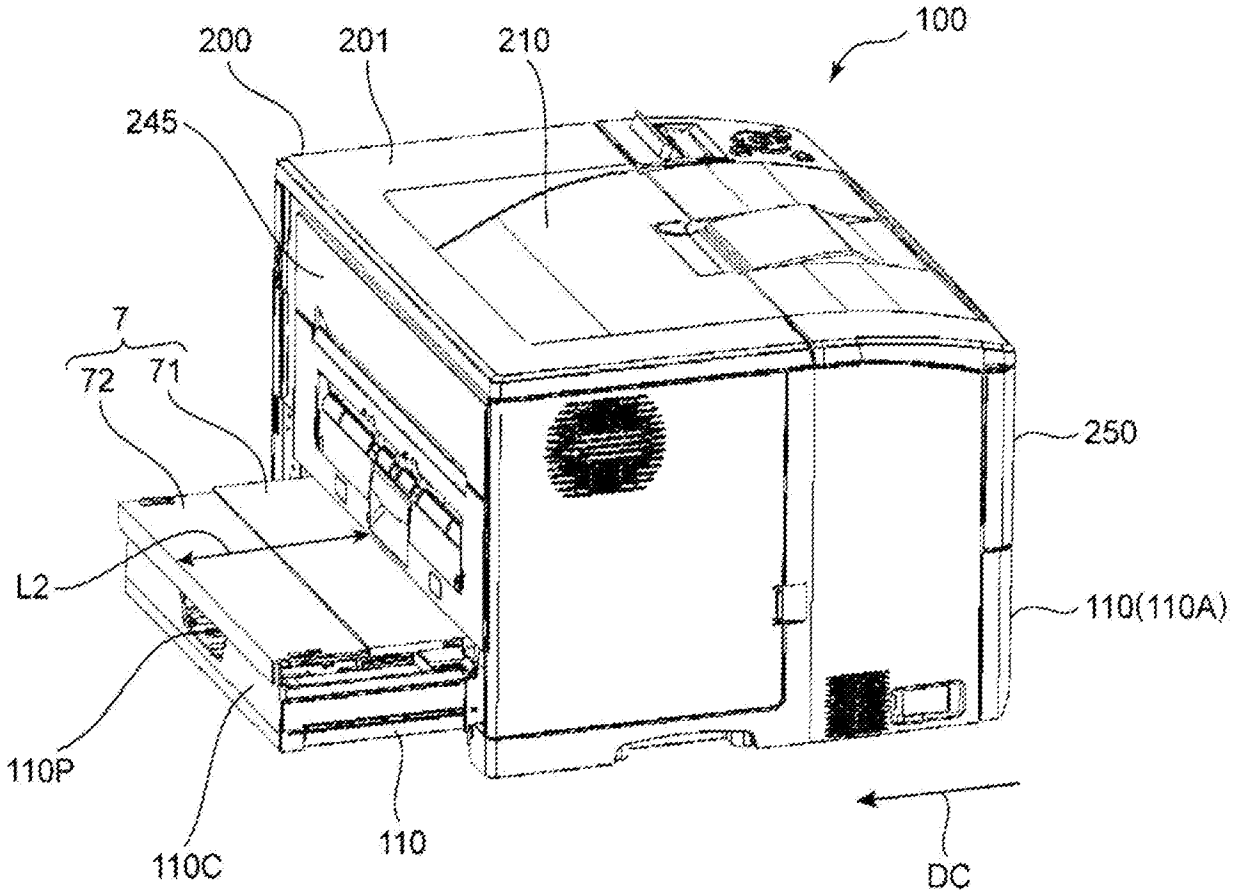
FIG. 6 is a perspective view of the printer according to one embodiment of the present disclosure, when part of the cassette protrudes to the outside.
Figure 7:
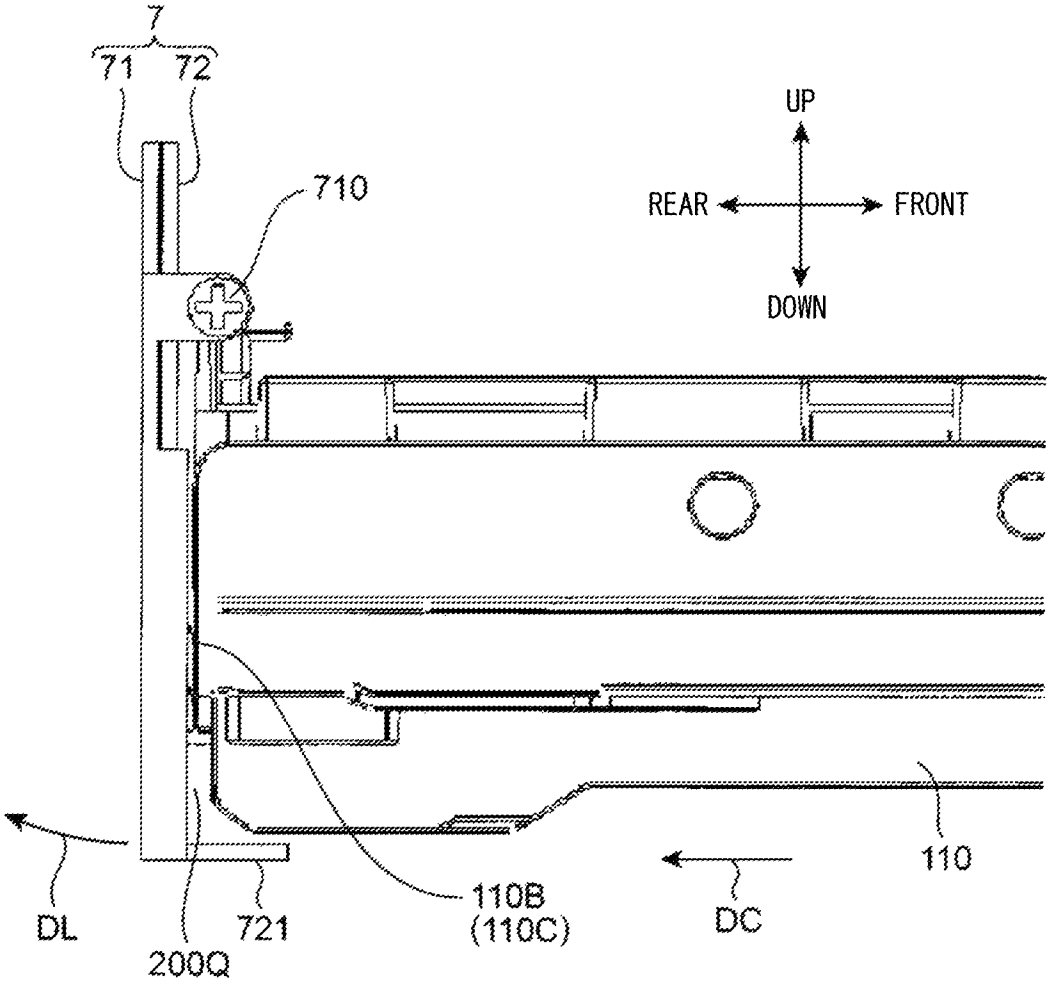
FIG. 7 is a sectional view showing a state in which a cassette cover seals an opening portion in the printer according to one embodiment of the present disclosure.
Figure 8:
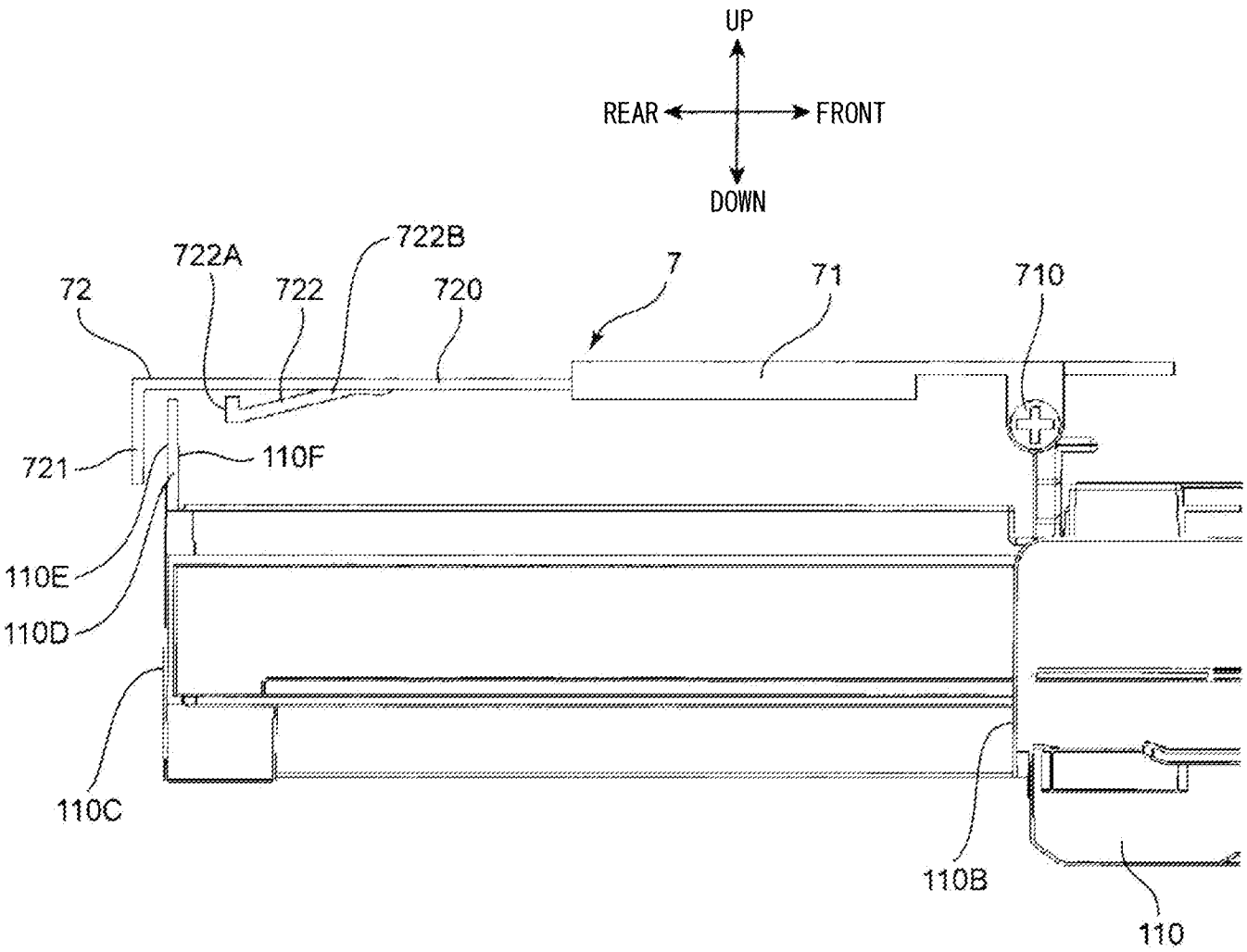
FIG. 8 is a sectional view showing a state in which the cassette cover of the cassette is open in the printer according to one embodiment of the present disclosure.
Figure 9:
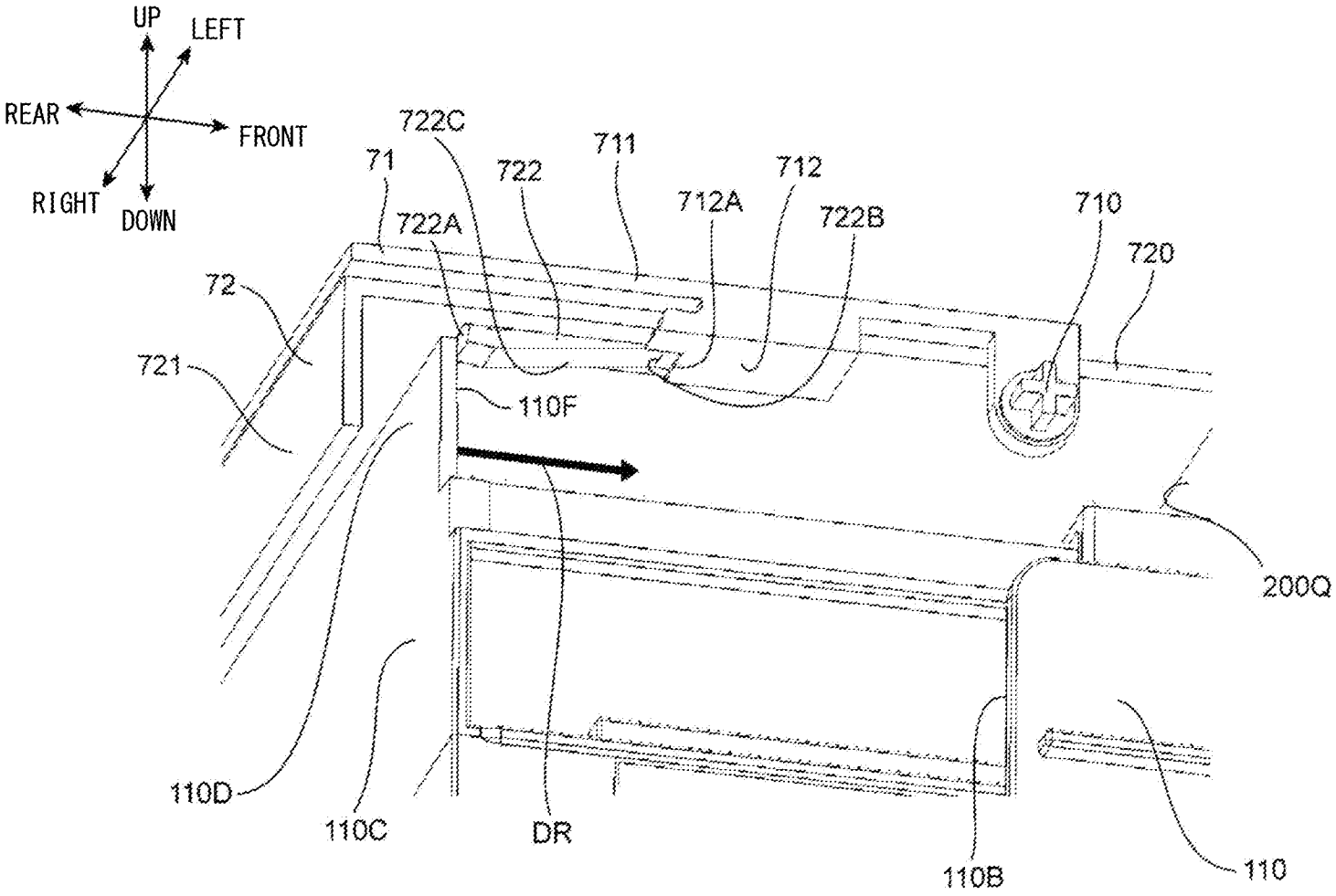
FIG. 9 is a perspective view of the area around the cassette cover when the cassette is pulled out from a housing.
Figure 10:
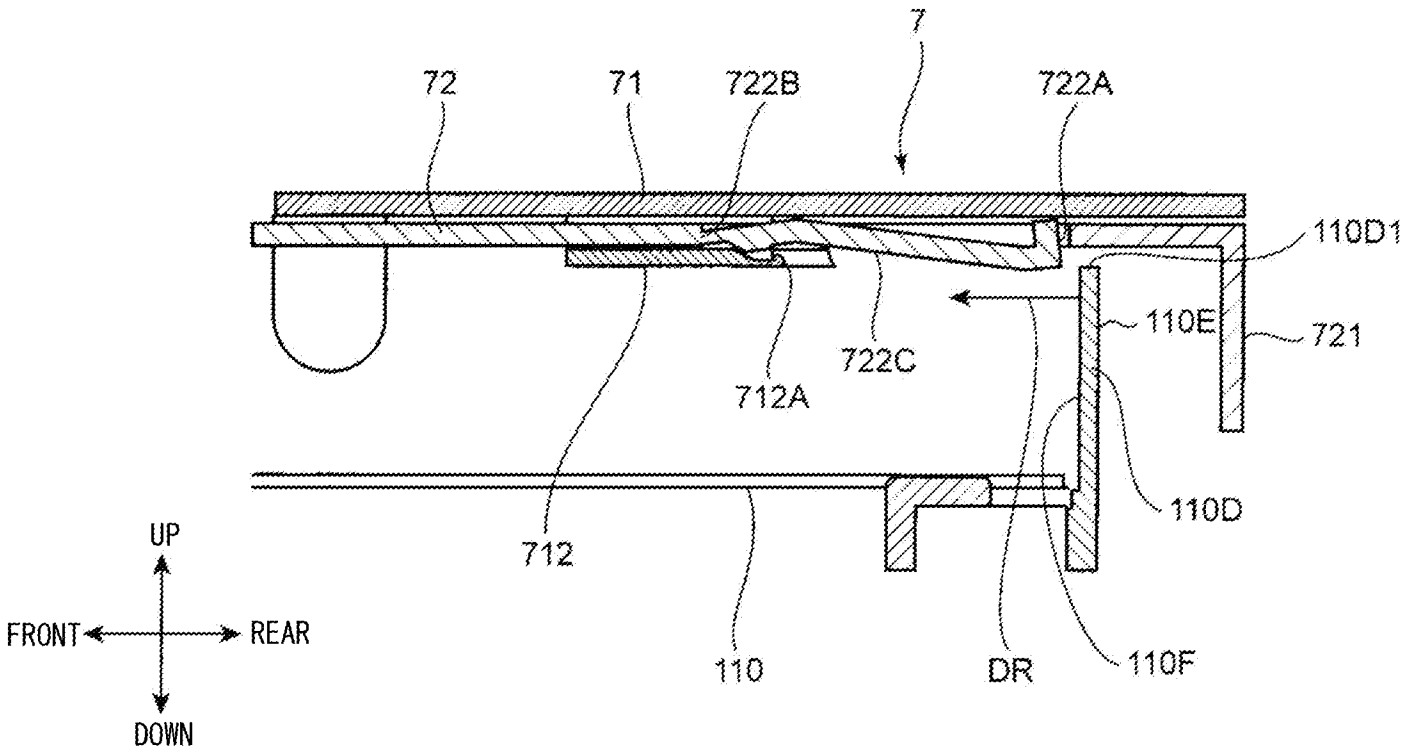
FIG. 10 is a sectional view of the area around the cassette cover in the state shown in FIG. 9.

In order to solve the above-described problems, the printer 100 according to the present embodiment includes the cassette cover 7 (cover member). Next, the structure and the functionality of the cassette cover 7 will be described with reference to FIGS. 6 to 10, in addition to FIGS. 2 and 3. FIG. 6 is a perspective view of the printer 100 according to the present embodiment, when part of the cassette 110 protrudes to the outside. FIG. 7 is a sectional view showing a state in which the cassette cover 7 seals the opening portion 200Q in the printer 100. FIG. 8 is a sectional view showing a state in which the cassette cover 7 of the cassette 110 is open in the printer 100. FIG. 9 is a perspective view of the area around the cassette cover 7 when the cassette 110 is pulled out from the housing 200. FIG. 10 is a sectional view of the area around the cassette cover 7 in the state shown in FIG. 9.

The cassette cover 7 is disposed below the back wall 245. In a first state in which the cassette 110 is not attached to the housing 200, the cassette cover 7 seals the opening portion 200Q and forms part of the back wall 245 (FIG. 2). In a second state in which the cassette 110 in the extended state is attached to the housing 200, the cassette cover 7 is pivoted by being abutted by the end portion on the downstream side in the insertion direction (rearward direction) of the cassette 110. Then, the cassette cover 7 covers the top of a portion of the cassette 110 that is exposed to the outside of the housing 200 (FIG. 6). In addition, as shown in FIG. 2, in the first state, the cassette cover 7 seals the opening portion 200Q in a compact state with a first length L1 in the vertical direction. On the other hand, in the second state, the cassette cover 7 covers the top of the cassette 110 with a second length L2 in the insertion direction that is greater than the first length L1 (FIG. 6). In other words, in the second state, the cassette cover 7 is extended from the first length L1 to the second length L2 by being abutted by the portion of the cassette 110 that is exposed to the outside of the housing 200. This enables the cassette cover 7 to cover a wider range of the cassette 110. This extension of the cassette cover 7 can be achieved by performing the operation of attaching the cassette 110 to the housing 200.

In the following, the extension mechanism of the cassette cover 7 will be described. The cassette cover 7 includes a first cover 71 (first plate) and a second cover 72 (second plate).

The first cover 71 is a plate-shaped member extending in the vertical direction in the first state shown in FIG. 7. The first cover 71 includes pivot portions 710 on the upper end side thereof. A pair of pivot portions 710 are disposed at lateral ends of the first cover 71. Each of the pivot portions 710 is a shaft portion extending in the left-right direction. The pivot portions 710 are inserted through bearing portions (not shown) disposed in the housing 200. Each pivot portion 710 serves as a pivot for the pivoting of cassette cover 7. The first cover 71 further includes a first substrate portion 711 and supporting portions 712.

The first substrate portion 711 is the portion constituting the body of the first cover 71. In the first state, the first substrate portion 711 extends in the vertical direction.

A pair of supporting portions 712 (FIG. 9) are disposed at lateral edges of the first substrate portion 711. Each supporting portion 712 is spaced apart from the first substrate portion 711, and slidably supports the second cover 72 between itself and the first substrate portion 711.

The second cover 72 is a plate-shaped member extending in the vertical direction in the first state shown in FIG. 7, as with the first cover 71. The second cover 72 extends along the first cover 71. This enables the cassette cover 7 to have a length within the range of the first length L1 in the first state.

Additionally, the second cover 72 is slidable relative to the first cover 71. This enables the cassette cover 7 to be extended to have the second length L2 in the second state by the second cover 72 being slid relative to the first cover 71. The second cover 72 includes a second substrate portion 720, a first energizing portion 721, and a second energizing portion 722.

The second substrate portion 720 is the portion constituting the body of the second cover 72. The second substrate portion 720 extends along the first substrate portion 711 and is inserted between the first substrate portion 711 and the supporting portions 712. This makes it possible to achieve the sliding movement of the second cover 72.

The first energizing portion 721 is disposed so as to intersect the second substrate portion 720 at the end portion on the downstream side in the insertion direction (rear side) of the second substrate portion 720 in the second state shown in FIG. 8. In other words, the first energizing portion 721 is provided extending downward and orthogonal to the second substrate portion 720. The first energizing portion 721 is energized by a first abutting surface 110E of an abutting portion 110D, which will be described later, of the cassette 110.

The second energizing portion 722 is disposed on the second substrate portion 720 in the second state shown in FIG. 8 in an area located on the upstream side (the front side) in the insertion direction relative to the first energizing portion 721. The second energizing portion 722 protrudes from the second substrate portion 720 so as to oppose the cassette 110. The second energizing portion 722 is constituted by a plate spring member. In the first state shown in FIG. 7, the second energizing portion 722 is accommodated between the first substrate portion 711 and the supporting portions 712 of the first cover 71. On the other hand, the second energizing portion 722 is detached rearward from the supporting portions 712 of the first cover 71 when the second cover 72 is slid in the insertion direction relative to the first cover 71.

The second energizing portion 722 includes a leading end portion 722A (free end portion), a fixed portion 722B (fixed end portion), and an inclined portion 722C. The fixed portion 722B is fixed to the second substrate portion 720, and forms a fixed end of the second energizing portion 722. In the second state shown in FIG. 8, the leading end portion 722A extends downward from the fixed portion 722B and toward the downstream side (rear side) in the insertion direction. The leading end portion 722A forms a free end of the second energizing portion 722. The second energizing portion 722 is energized by a second abutting surface 110F of the abutting portion 110D, which will be described later, of the cassette 110. The inclined portion 722C is an inclined portion disposed so as to oppose the cassette 110 between the leading end portion 722A and the fixed portion 722B. In the second state, the inclined portion 722C is inclined downward and facing forward.

Meanwhile, the cassette 110 includes an abutting portion 110D (FIG. 8). The abutting portion 110D is disposed in a portion above the cassette rear face portion 110C at an end portion on the downstream side in the insertion direction of the cassette 110. The abutting portion 110D includes a first abutting surface 110E and a second abutting surface 110F. The first abutting surface 110E constitutes the rear face of the abutting portion 110D. The first abutting surface 110E abuts the first energizing portion 721 of the second cover 72 when the cassette 110 is inserted into the housing 200 and exposed to the outside from the opening portion 200Q. This makes it possible to cause the cassette cover 7 to be extended in conjunction with the operation of attaching the cassette 110. The second abutting surface 110F constitutes the surface opposite the first abutting surface 110E, or in other words, the front surface of the abutting portion 110D. In a third state in which the cassette 110 is detached from the housing 200 in the direction opposite to the insertion direction, the second abutting surface 110F abuts the leading end portion 722A of the second energizing portion 722 of the second cover 72.

Next, a description will be given of the function of the cassette cover 7 in attaching and detaching the cassette 110 to and from the housing 200. As shown in FIGS. 2 and 6, when the cassette 110 is not attached to the housing 200 or the cassette 110 in the contracted state (FIG. 4) is attached to the housing 200, the cassette cover 7 seals (closes) the opening portion 200Q and forms part of the back wall 245. On the other hand, when the cassette 110 in the extended state (FIG. 5) is inserted into the body internal space 260 from the insertion portion 200P of the housing 200 (the direction indicated by the arrow DC in FIGS. 3 and 6), the cassette rear face portion 110C of the cassette 110 abuts the cassette cover 7. Consequently, the cassette cover 7 is pivoted about the pivot portion 710 (in the direction indicated by the arrow DL in FIG. 7), allowing the cassette 110 to be exposed to the outside of the housing 200. As the cassette 110 is moved toward the outside of the housing 200, the abutting portion 110D of the cassette 110 passes below the supporting portions 712, and thereafter, the first abutting surface 110E of the abutting portion 110D abuts the first energizing portion 721. The first abutting surface 110E energizes the first energizing portion 721 in the insertion direction, while causing the second cover 72 to slide rearward relative to the first cover 71. At this time, the second energizing portion 722 of the second cover 72 is detached from between the first substrate portion 711 and the supporting portions 712 of the first cover 71 (see FIGS. 8 and 9). When the cassette 110 in the extended state is completely attached to the housing 200, the cassette cover 7 covers the top of a portion of the cassette 110 that is exposed to the outside of the housing 200 as shown in FIG. 8. At this time, the cassette cover 7 is extended to have the second length L2 (FIG. 6) in the second state from the first length L1 (FIG. 2) in the first state. This prevents the entry of a foreign object such as a clip into the sheet accommodating portion 1105 (FIG. 5) of the cassette 110.

On the other hand, in the third state in which the cassette 110 is detached from the housing 200, the cassette 110 is moved in the opposite direction (forward direction) to the insertion direction. At this time, the second abutting surface 110F of the abutting portion 110D of the cassette 110 energizes the leading end portion 722A of the second energizing portion 722 of the second cover 72 forward (indicated by the allow DR in FIGS. 9 and 10). Consequently, the second cover 72 is moved such that the second cover 72 overlaps the first cover 71, or in other words, in the direction in which the cassette cover 7 is contracted. When the fixed portion 722B of the second energizing portion 722 eventually reaches supporting end portions 712A of the supporting portions 712 (FIG. 9), the second energizing portion 722 starts to be accommodated in the space between the first substrate portion 711 and the supporting portions 712. At this time, the second energizing portion 722 elastically deforms such that the leading end portion 722A of the second energizing portion 722 moves upward while the inclined portion 722C of the second energizing portion 722 is sliding against the supporting end portions 712A. Then, substantially simultaneously with the accommodation of the second energizing portion 722 between the first substrate portion 711 and the supporting portions 712, the leading end portion 722A of the second energizing portion 722 is separated from an upper end portion 110D1 of the abutting portion 110D. At this time, the second cover 72 is brought into a state in which it overlaps the first cover 71, and the length of the cassette cover 7 is returned to the first length L1. Thereafter, the abutting portion 110D is moved toward the body internal space 260 of the housing 200, while passing below the supporting portion 712. Along with the movement of the cassette 110, the cassette cover 7 is pivoted downward about the pivot portion 710 by the self weight of the cassette cover 7. That is, the abutting portion 110D abuts the first energizing portion 721 and the second energizing portion 722, making it possible to achieve extension and contraction of the cassette cover 7. When the cassette 110 is eventually detached from the cassette cover 7, the pivoting causes the cassette cover 7 to promptly seal the opening portion 200Q with the first length L1 (FIG. 2) again. This inhibits the entry of a foreign object into the body internal space 260 of the housing 200.

Additionally, in the present embodiment, a grip opening portion 110P (cut-away portion) is formed in the cassette rear face portion 110C of the cassette 110. The grip opening portion 110P is formed in the cassette rear face portion 110C at a position opposing the actuator 8 in a sheet width direction intersecting the insertion direction. This further inhibits interference between the cassette rear face portion 110C and the actuator 8 when the cassette 110 passes through the body internal space 260.

As described above, according to the above embodiment, the cassette 110 in the extended state is inserted from the front wall 250 into the body internal space 260 in the direction intersecting the front wall 250, and is attached to the housing 200 in a protruding manner from the back wall 245 to the outside of the housing 200. Then, the cassette 110 accommodates a sheet therein in the state in which it is open at its top. Since the cassette 110 is open at its top, a foreign object tends to enter the portion of the cassette 110 that protrudes from the housing 200 to the outside. Even in such a case, in the second state in which the cassette 110 is attached to the housing 200, the cassette cover 7 is pivoted by being abutted by the end portion on the downstream side in the insertion direction of the cassette 110, thereby covering the top of a portion of the cassette 110 that is exposed to the outside of the housing 200. This suitably protects the top of the cassette 110, and inhibits the entry of a foreign object into the cassette 110. Furthermore, in the first state, the cassette cover 7 seals the opening portion 200Q, and forms part of the back wall 245. Also, the cassette cover 7 is moved to the outside of the housing 200 by being pivoted during a change from the first state to the second state. This prevents the cassette cover 7 from passing through the body internal space 260 of the housing 200, thus inhibiting interference between the cassette cover 7 and other members disposed in the body internal space 260.

Although the printer 100 (image forming apparatus) including the cassette cover 7 according to the embodiment of the present disclosure has been described thus far, the present disclosure is not limited thereto. For example, the following modifications may be made to the embodiment.

Although in the above-described embodiment, the abutting portion 110D is disposed above the cassette rear face portion 110C, the present disclosure is not limited thereto. The abutting portion 110D may be disposed, for example, on a side wall of the cassette 110.

Although in the above-described embodiment, the first cover 71 of the cassette cover 7 is disposed outside the housing 200 and the second cover 72 is disposed inside the housing 200, the present disclosure is not limited thereto. The second cover 72 capable of relative sliding movement may be disposed outside the housing 200. In this case, the sliding movement of the second cover 72 can be enabled by disposing an energizing portion that is similar to the first energizing portion 721 at both end portions in the sheet width direction of the second cover 72.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a housing including a first wall portion extending in a vertical direction, a second wall portion extending in the vertical direction on a side opposite from the first wall portion, and an internal space formed between the first wall portion and the second wall portion;

an image forming portion that is disposed in the internal space and forms an image on a sheet;

a sheet cassette that is inserted from the first wall portion into the internal space in an insertion direction intersecting the first wall portion, is attached to the housing in a protruding manner from the second wall portion to the outside of the housing, is open at a top thereof, and accommodates the sheet therein;

an opening portion that is formed in the second wall portion and through which the sheet cassette passes; and a cover member that, in a first state in which the sheet cassette is not attached to the housing, seals the opening portion with a first length in the vertical direction and forms part of the second wall portion, and, in a second state in which the sheet cassette is attached to the housing, is pivoted by being abutted by part of the sheet cassette and covers a top of a portion of the sheet cassette, that is exposed to the outside of the housing, with a second length in the insertion direction that is greater than the first length in the vertical direction.

2. The image forming apparatus according to claim 1, wherein, in the second state, the cover member is extended from the first length to the second length by being abutted by the sheet cassette.

3. The image forming apparatus according to claim 2, wherein the cover member includes:

a first plate that extends in the vertical direction, and includes, on an upper end side thereof, a pivot portion serving as a pivot for the pivoting of the cover member in the first state, and;

a second plate including a first energizing portion that is energized by the sheet cassette, extending along the first plate, and being slidable relative to the first plate, and the sheet cassette includes an abutting portion having a first abutting surface capable of abutting the first energizing portion of the second plate, and the cover member is pivoted about the pivot portion by the sheet cassette abutting the cover member, and the second plate is slid relative to the first plate and the cover member is extended from the first length to the second length by the first abutting surface of the sheet cassette abutting the first energizing portion of the second plate.

4. The image forming apparatus according to claim 3, wherein the first plate includes:

a first substrate portion extending in the vertical direction in the first state; and a supporting portion that is spaced apart from the first substrate portion and slidably supports the second plate between the first substrate portion and the supporting portion, the second plate includes:

a second substrate portion that extends along the first substrate portion and is inserted between the first substrate portion and the supporting portion;

the first energizing portion, disposed so as to intersect the second substrate portion at an end portion on a downstream side in the insertion direction of the second substrate portion in the second state and is energized by the first abutting surface of the sheet cassette; and a second energizing portion that protrudes so as to oppose the sheet cassette on an upstream side in the insertion direction relative to the first energizing portion of the second substrate portion in the second state, and, in a third state in which the sheet cassette is detached from the housing in a direction opposite to the insertion direction, a second abutting surface that is opposite the first abutting surface included in the abutting portion of the sheet cassette abuts the second energizing portion of the second plate, and thereby the second plate is slid relative to the first plate and the cover member is contracted from the second length to the first length.

5. The image forming apparatus according to claim 4, wherein, in the third state, upon detachment of the sheet cassette from the cover member, the cover member is pivoted about the pivot portion by a self weight of the cover member, and seals the opening portion.

6. The image forming apparatus according to claim 4, wherein the second energizing portion is a plate spring member including:

a fixed end portion fixed to the second substrate portion;

a free end portion that, in the second state, extends downward from the fixed end portion and toward the downstream side in the insertion direction, and is abutted by the second abutting surface of the abutting portion; and an inclined portion disposed between the fixed end portion and the free end portion so as to oppose the sheet cassette, and the abutting portion of the sheet cassette energizes the first energizing portion in the insertion direction along with a change from the first state to the second state, while causing the second energizing portion to be detached from between the first substrate portion and the supporting portion, and energizes the free end portion of the second energizing portion along with a change from the second state to the third state, while causing the inclined portion to abut the supporting portion of the first plate so as to accommodate the second energizing portion between the first substrate portion and the supporting portion, thereafter passes below the supporting portion, and is detached from the cover member.

7. The image forming apparatus according to claim 6, wherein, in the third state, upon detachment of the sheet cassette from the cover member, the cover member is pivoted about the pivot portion by a self weight of the cover member, and seals the opening portion.

8. The image forming apparatus according to claim 1, comprising an actuator that is disposed in the internal space at a position overlapping the cover member in the vertical direction, and detects the presence or absence of the sheet by abutting the sheet accommodated in the sheet cassette.

9. The image forming apparatus according to claim 8, comprising a wall portion that is provided upright at an end portion on a downstream side in the insertion direction of the sheet cassette, and includes an abutting portion thereabove, wherein the wall portion includes a cut-away portion that is formed at a position opposing the actuator in a sheet width direction intersecting the insertion direction, and into which the actuator enters when the sheet cassette passes through the internal space.

10. The image forming apparatus according to claim 1, wherein the sheet cassette is extendable in the insertion direction according to a size of the sheet accommodated therein, and, when extended in the insertion direction, is attached to the housing in a protruding manner from the second wall portion to the outside of the housing with the top thereof being covered by the cover member.

* * * * *